US006004471A

United States Patent [19]

Chuang

[11] Patent Number: 6,004,471

[45] Date of Patent: Dec. 21, 1999

[54] STRUCTURE OF THE SENSING ELEMENT OF A PLATINUM RESISTANCE THERMOMETER AND METHOD FOR MANUFACTURING THE SAME

[75] Inventor: Feng-Ju Chuang, Hsinchu, Taiwan

[73] Assignee: Opto Tech Corporation, Hsinchu, Taiwan

[21] Appl. No.: 09/019,434

[22] Filed: Feb. 5, 1998

[51] Int. Cl.[6] ..... H01B 1/14

[52] U.S. Cl. ..... 216/16; 216/39; 216/41; 438/702; 29/620; 374/114; 338/25

[58] Field of Search ..... 216/16, 39, 41; 29/610.1, 620; 438/702; 374/114; 338/25; 427/101, 117, 118, 123, 124, 125

[56] References Cited

U.S. PATENT DOCUMENTS

| | | | |
|---|---|---|---|
| 4,805,296 | 2/1989 | Jinda et al. | 29/620 |
| 5,024,966 | 6/1991 | Dietrich et al. | 437/60 |
| 5,140,393 | 8/1992 | Hijikihigawa et al. | 357/25 |

*Primary Examiner*—Randy Gulakowski
*Assistant Examiner*—Allan Olsen
*Attorney, Agent, or Firm*—Bacon & Thomas

[57] ABSTRACT

The structure of the sensing element of a platinum resistance thermometer and method for manufacturing the same, in which the silicon wafer is used as a substrate. A silicon substrate is etched to form a desired wiring pattern, then a silicon dioxide layer is grown as a layer of thermal oxide on the silicon substrate by heating the etched substrate in an oxygen-containing atmosphere. After a platinum film is deposited onto the surface of the silicon dioxide layer, the platinum-coated substrate is subject to gentle polishing. The platinum membrane outside the etched groove is easily detached while the platinum layer inside the etched groove remains attached. Thus a platinum circuit with a desired circuit pattern is formed on the substrate. After heat treatment in a temperature range of 750° C.~ 1500° C. and further processing, the sensing element of a platinum resistance thermometer is obtained. The platinum circuit thus formed is submerged in an groove and has a substantially bulk structure.

6 Claims, 5 Drawing Sheets

STRUCTURE OF THE SENSING ELEMENT OF A PLATINUM RESISTANCE THERMOMETER AND METHOD FOR MANUFACTURING THE SAME

BACKGROUND OF THE INVENTION

1. Field of the Invention

The present invention relates to the structure of the sensing element of a platinum resistance thermometer and the method for manufacturing the same.

2. Description of the Prior Art

Resistance thermometer devices (RTD) are used for measuring temperature by relating the resistance of its "sensing element" to the temperature. An RTD sensing element comprises mainly a circuit made of a metal or alloy whose resistance changes with temperature. The resistance of a sensing element increases in an approximately linear manner with the increasing rate defined as the temperature coefficient of resistance (TCR) of the device. In other words, a RTD with higher TCR is more sensitive than a RTD with lower TCR. It is also well known that the higher the concentration of impurities in the metal or alloy of the circuit, the lower the value of TCR.

Platinum in wire or ribbon form has long been considered as a primary resistance and temperature measuring standard because of its chemical inertness and physical stability. As platinum is used to form the circuit of the sensing element, platinum has another advantage of possessing a high TCR value which increases the sensitivity of the RTD to temperature change. In addition, the resistance of a platinum circuit increases in an almost linear manner with respect to absolute temperature within the range of −200° C.~ 1000° C., whereby the accurate temperature can be easily derived over a wide range of temperature. Therefore, platinum resistance thermometers are well studied and widely utilized. Standards for these platinum resistance thermometers are specifically set forth in JIS C-1604, DIN 43760, and IEC Pub.751, wherein DIN 43760 is generally used as standard which has a standard TCR value 3850 ppm $(° C.)^{-1}$ of platinum resistance thermometer.

It is to be noted that, when comparing a thin film platinum circuit with a bulk platinum circuit, the TCR value of the former is typically lower than that of the latter, which is called "bulk effect". Therefore, a platinum RTD having a bulk platinum circuit is superior to a platinum RTD having a thin film platinum circuit in its sensitivity.

However, the conventional platinum RTDs are relatively expensive, not only because of the expansiveness of platinum, but also because of the high manufacturing costs of platinum sensing elements. A conventional platinum RTD is typically made by forming the circuit pattern of platinum sensing element on the surface of a dielectric layer. Unfortunately, pure platinum exhibits poor adhesiveness to most practical dielectric materials, and the platinum circuit pattern deposited on the surface of dielectric substrate may easily be detached from the surface. Some dielectric materials exhibit good adhesiveness to platinum, but still suffer from their own drawbacks. For example, the silicone substrate is preferred in that it is comparatively cheap, with a good smoothness, and can be easily processed, however, an platinum-silicon alloy is formed during the heat-treatment at high temperature, thus resulting in a problem related to the characteristics of sensing element. The silicon dioxide substrate is relatively cheap, but has the drawback that no sufficient adhesion with respect to platinum can be provided. The alumina substrate is inexpensive and heat-resistant and with superior adhesion to platinum, but its rough surface leads to difficulties in the formation of fine pattern. Although the surface may be smoothed by surface polishing, the polishing of the alumina substrate having a large hardness results in an extreme cost increase in the substrate material. The sapphire substrate is superior in heat-resistance, adhesion with respect to platinum, and surface smoothness; however, it is very expensive and it is difficult to be cut into small chips. Accordingly, typical platinum resistance thermometers are manufactured by forming a platinum pattern on the surface of a dielectric material using specially developed fabricating processes and/or equipment, thereby greatly increases the manufacturing cost.

To solve the aforementioned problems, a platinum RTD is disclosed in U.S. Pat. No. 4,129,848. As shown in FIG. 1A, a layer of silicon dioxide 12 is grown on the upper surface of a clean silicon substrate 11 by heating substrate 11 in an oxygen-containing atmosphere. The exposed surface of silicon dioxide layer 12 is roughened by sputtering etch to produce many microscopic pits or holes extending from the exposed surface downward but not so far as substrate 11 (FIG. 1B). Subsequently platinum layer 13 is deposited onto the surface of silicon dioxide layer 12 by sputtering deposition using a two-step process. This roughened interface between the silicon dioxide layer 12 and the platinum layer 13 increases the adhesion of the platinum layer 13 to silicon dioxide layer 12 (FIG. 1C). A quartz layer is sputtering deposited over the platinum layer 13, and then coated with a photoresist mask for chemical etching. The chemically etched quartz layer forms a quartz mask 14 having a positive pattern identical to the desired platinum circuit pattern (FIG. 1D). The exposed platinum layer 13 and part of the quartz mask 14 are then sputtering etched away, leaving the platinum protected by the quartz mask 14 in a predetermined pattern, that is, platinum circuit pattern 15. Subsequently the quartz mask 14 is removed and further procedures like heat treatment are proceeded. However, sputtering etch process tends to introduce impurities and cause the loss of definition at the edges of the platinum pattern. In detail, sputtering etch of the silicon dioxide causes deposition of the silicon dioxide molecule into the platinum as impurity, and the platinum structure is affected at its edges so that there is loss of definition. Besides, the exposed surface of the silicon dioxide layer 12 may also be etched away because of the poor selectivity of sputtering etch procedure. As mentioned earlier, a highly pure platinum circuit is required for maintaining the TCR value of a platinum sensing element, the introduced impurities changes the TCR value of the thermometer, thus dramatically affects the accuracy of the platinum RTD.

In a commercialized platinum thermometer, platinum circuit is typically disposed on the surface of a dielectric substrate like alumina having excellent adhesion to platinum. The U.S. Pat. No. 4,805,296 discloses a method for manufacturing platinum resistance thermometer, in which a platinum layer is sputtering deposited on an alumina film located on the surface of a silicon substrate, and the platinum circuit pattern is formed by sputtering etch as well. However, use of mask to etch away the platinum film in unwanted areas causes a problem that the pattern cannot reasonably be defined with desired precision and uniformity for obtaining a small size and close spacing of the strip section. In addition, the mask layers tend to deteriorate before the etching process is complete and impurities tend to be introduced into the platinum. Therefore, most patents relating to the platinum resistance thermometer (e.g., U.S. Pat. No. 4,050,052, 4,103,275, 4,469,717, 4,627,902, and 4,649,364) describe only the processing conditions for treating the platinum and substrate, while the detailed process for forming the platinum pattern are absent.

A method for forming a platinum resistance thermometer without using a sputtering-etch mask is disclosed in U.S. Pat. No. 5,089,293, in which an alumina (or sapphire) substrate having excellent adhesiveness to platinum is employed. Referring to FIG. 2A, a silicon dioxide layer 22, which is called a liftoff medium, is deposited on the upper surface of substrate 21. A photoresist pattern 24 is formed after a desired path pattern has been exposed on the photoresist and the photoresist is developed, leaving the strip pattern in the photoresist over the surface of silicon dioxide layer 22 (FIG. 2B). The underlying silicon dioxide layer 22 is chemically etched in the areas not protected by photoresist pattern 24, thereby defines a desired path, that is, a positive pattern, on the surface of the substrate 21 for deposition of a platinum circuit pattern (FIG. 2C). After the photoresist pattern 24 has been completely removed from the remaining negative patterned silicon dioxide layer 22, the substrate 21 is ready for deposition of platinum (FIG. 2D). Platinum is then sputtering deposited on the negative patterned silicon dioxide layer 22 and on the exposed surface of substrate 21 to form a platinum layer 23, as shown in FIG. 2E. The silicon dioxide layer 22 has a thickness of at least 1.3 to 1.5 times that of the platinum layer 23. Referring now to FIG. 2F, an interconnecting section 23A, located on the side surface of silicon dioxide layer 22, interconnects between the platinum layer on the silicon dioxide layer 22 and the platinum layer on the substrate 21. The deposition condition is carefully controlled so that the interconnecting section 23A forms a porous thin-film structure. The interconnecting section 23A is sufficiently porous so that an etching solution will pass through the thin film. Hydrofluoric acid is then added to etch away the remaining parts of the silicon dioxide layer 22 within the intersectional space between the substrate 21 and the platinum layer 23. After etching all of the silicon dioxide layer 22 away, the portions of the platinum layer located on top of the silicon dioxide layer may be mechanically separated from the portions of the platinum layer deposited on the surface of substrate 21 in the region of the interconnecting section 23A. The platinum layer deposited on the surface of substrate 21 is tightly bond to the substrate surface, thus a platinum circuit pattern 25 of a resistance thermometer is formed on the surface of substrate 21 (FIG. 2G). All the materials and processing procedures are carefully chosen such that contamination to platinum is avoided.

According to the aforementioned method disclosed in U.S. Pat. No. 5,089,293, a platinum resistance thermometer having defined platinum pattern and pure platinum circuit can be obtained. However, because of their hardness, the alumina or sapphire substrate used in this prior art is difficult to handle, while the subsequent processing and further treatments are also hard to proceed. Besides, etching a hindered liftoff medium away through the porous thin platinum film requires some specialized manufacturing processes and equipment, thereby greatly increases the fabricating cost.

From the aforementioned prior arts, one can finds that the price of a platinum RTD sensing element can be lowered when the fabricating cost of this platinum RTD sensing element is greatly reduced by batch producing the platinum sensing element having purest platinum circuit with the typical procedures and equipment commonly used in the semiconductor industry. In addition, the platinum RTD sensing element and other integrated circuits can be formed on a single chip if a silicon substrate is used, thereby reduces the size and simplifies the assembling procedures of RTD.

SUMMARY OF THE INVENTION

Therefore, an object of the present invention is to provide the structure of a platinum resistance thermometer and the method for manufacturing the same, wherein a platinum resistance sensing element is formed on a silicon substrate and is fabricated by using the materials and manufacturing processes typically employed in the semiconductor industry, whereby greatly decreases the fabrication cost and lowers the price of the platinum resistance thermometer.

Another object of the present invention is to provide the structure of a platinum resistance thermometer and the method for manufacturing the same, in which a high-purity platinum circuit can be obtained, thereby increases the TCR value of the platinum resistance thermometer.

Yet another object of the present invention is to provide the structure of a platinum resistance thermometer and the method for manufacturing the same, in which a platinum resistance sensing element having a bulk platinum circuit can be obtained, and a better sensitivity of this thermometer can be achieved.

The silicon wafer is used as the substrate of a platinum resistance sensing element according to the preferred embodiment of the present invention. An groove having a desired circuit pattern is first formed on the top surface of a silicon substrate by chemical etching using a silicon dioxide layer as a mask. The mask is removed and the etched silicon substrate having a groove on its top surface is then subjected to thermal oxidation to grow a layer of silicon dioxide on the top surface of the silicon substrate and the groove. The grown silicon dioxide layer can be divided into two portions: a concave portion which is grown from the concave rough surface of the groove, and a smooth portion which is grown from the original polished substrate surface. Sputtering deposition is then proceeded to deposit a layer of platinum onto the surface of the silicon dioxide layer, and the substrate having a silicon dioxide layer and the platinum layer thereon is then treated with gentle polishing. Since the adhesion of platinum to smooth silicon dioxide surface is poor, a part of the platinum layer deposited on the smooth portion of silicon dioxide layer is easily detached from the silicon dioxide layer. On the contrary, the other part of the platinum layer deposited onto the concave portion of silicon dioxide layer remains attached because of the groove structure, and that the adhesion of the platinum layer to the scabrous surface of the concave portion is good. The portion of platinum layer within the groove forms a platinum circuit pattern which is substantially identical to the pattern of the groove, that is, the desired circuit pattern. After further processing like heat treatment and wiring, a platinum resistance sensing element is formed.

Additionally, when a specific etching solution is used to etch the groove into a V-groove (i.e., a groove having a V-shaped cross section), the platinum deposited within the groove tends to cumulate at the bottom of the V-groove instead of spreading over the surface of the groove uniformly, thereby a platinum circuit having a substantially bulk structure is formed. The TCR value of the platinum resistance sensing element becomes higher, thus the sensitivity of a platinum RTD increases.

The advantages of the platinum resistance sensing element according to the present invention are listed below. First, the silicon substrate, widely used in the semiconductor industry, is comparatively cheap, steadily supplied, with a good smoothness, thoroughly studied, and easily processed. Both the physical and chemical properties of silicon are well defined. Next, the manufacturing equipment of the platinum resistance sensing element according to the present invention are all commonly used in the semiconductor industry, and the production procedures are all ordinary processes; therefore, both the cost of equipment and the developing expenditure are greatly reduced. The platinum resistance sensing element having uniform quality can be mass-produced with a batch-fabricating procedure, which further lessens the production cost. In addition, the platinum circuit of the platinum resistance thermometer according to the present invention is not contaminated during manufacturing, which results in much greater control of the TCR value of the platinum RTD sensing element, and batch to batch variations are also greatly reduced. Besides, a bulk platinum circuit can be obtained with a specific groove, thereby the TCR value of the platinum resistance thermometer is further increased. Finally, the major difference between the present invention and the prior art is that the platinum circuit of a platinum resistance thermometer according to the present invention is disposed within the groove under the surface of a substrate, while the platinum circuit of a platinum resistance thermometer in accordance with the prior art is disposed above the surface of a substrate; therefore, a platinum circuit pattern in accordance with the present invention can be easily defined by removing the unwanted portion of platinum layer using mechanical processes like polishing, and the formed platinum circuit is protected by the groove structure.

DETAILED DESCRIPTION OF THE PREFERRED EMBODIMENT

Figure 1A:
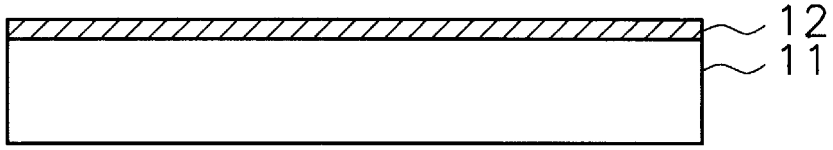
FIG. 1A (PRIOR ART)
FIGS. 1A through 1E illustrate the cross sectional views of a prior platinum resistance thermometer showing the device in various stages of construction.
Figure 1B:
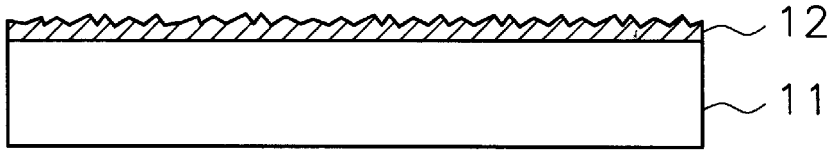
FIG. 1B (PRIOR ART)
Figure 1C:
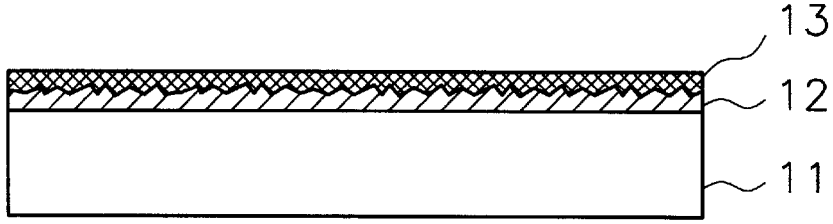
FIG. 1C (PRIOR ART)
Figure 1D:
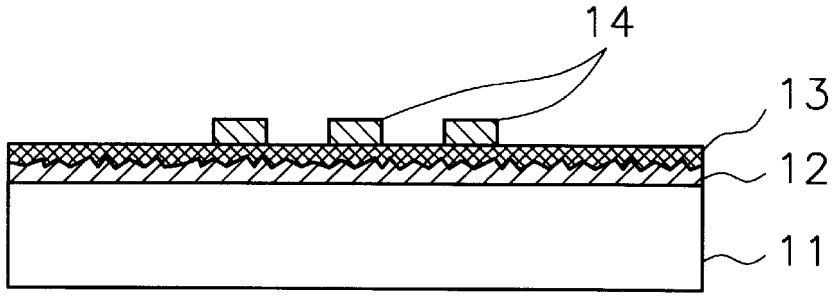
FIG. 1D (PRIOR ART)
Figure 1E:
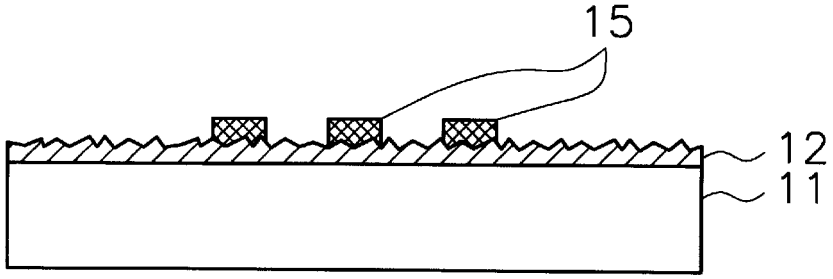
FIG. 1E (PRIOR ART)
Figure 2A:
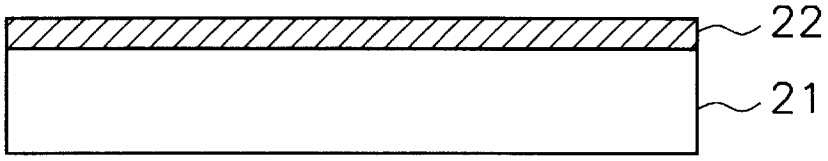
FIG. 2A (PRIOR ART)
FIGS. 2A through 2G illustrate the cross sectional views of another prior platinum resistance thermometer showing the device in various stages of construction.
Figure 2B:
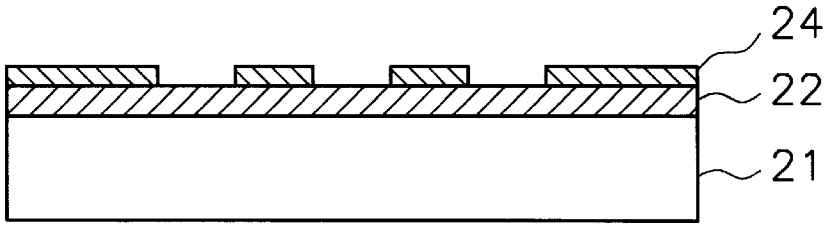
FIG. 2B (PRIOR ART)
Figure 2C:
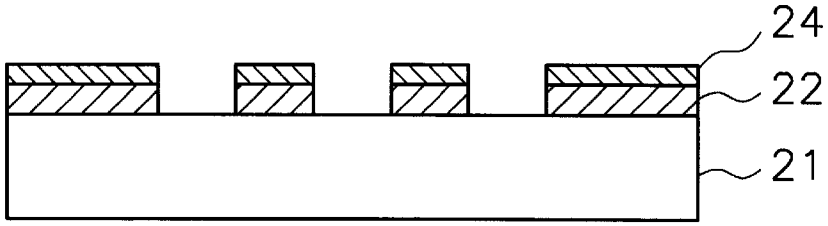
FIG. 2C (PRIOR ART)
Figure 2D:
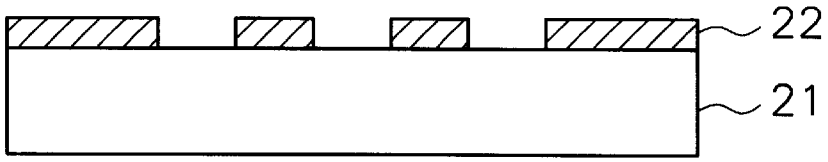
FIG. 2D (PRIOR ART)
Figure 2E:
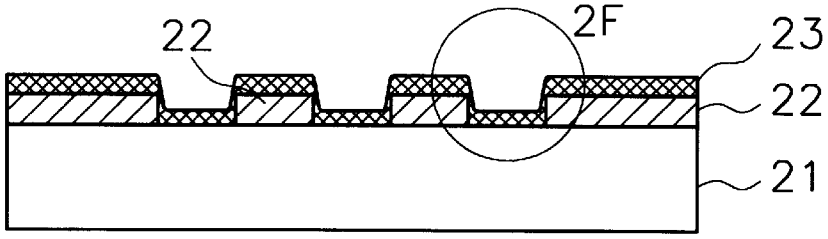
FIG. 2E (PRIOR ART)
Figure 2F:
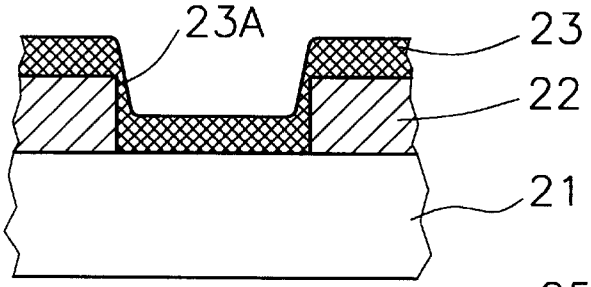
FIG. 2F (PRIOR ART)
Figure 2G:
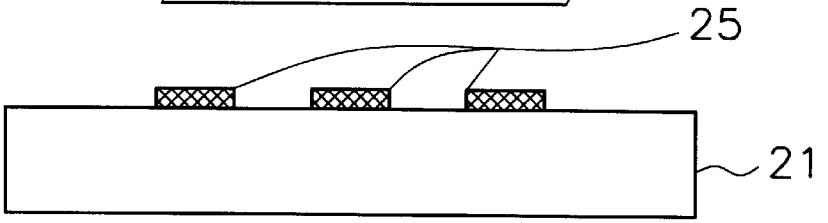
FIG. 2G (PRIOR ART)
Figure 3A:
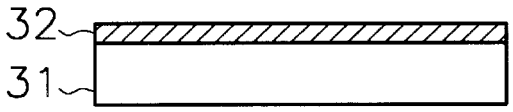
FIGS. 3A through 3H illustrate the cross sectional views of the platinum resistance thermometer according to the preferred embodiment of the present invention which show the device in various stages of construction.
Figure 3E:
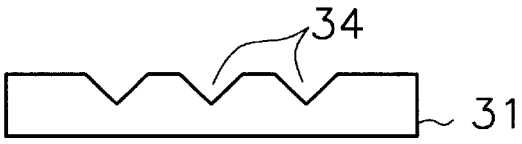
Figure 3B:
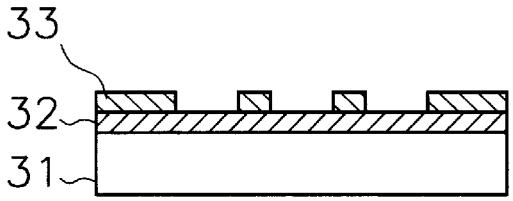

The structure of a platinum resistance thermometer and method for manufacturing the same according to the present invention will now be illustrated by the description of a preferred embodiment and the appended drawings. As shown in FIGS. 3A and 3B, a layer of silicon dioxide 32 is first formed on the top surface of the silicon substrate 31, and a photoresist pattern 33 substantially identical to the negative pattern of the desired platinum circuit pattern is then formed on the surface of the silicon dioxide 32. By using the photoresist pattern 33 as a mask, the silicon dioxide 32 is etched to remove the portion not protected by the photoresist pattern 33, thereby a window is formed in the silicon dioxide 32 and part of the surface of the silicon substrate 31 is exposed through the window. After etching, the exposed surface of the silicon substrate 31 forms a pattern which is substantially identical to the desired platinum circuit pattern, as shown in FIG. 3C.

Figure 3D:
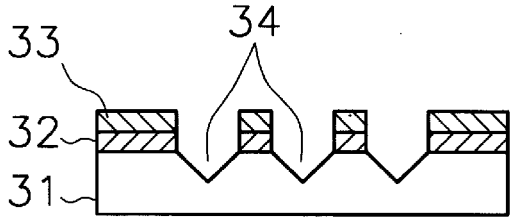
Figure 3H:
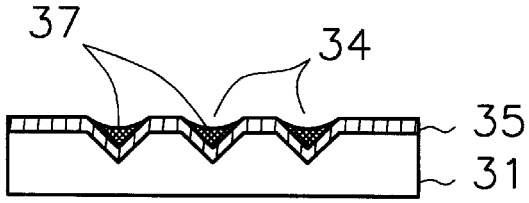
Figure 4:
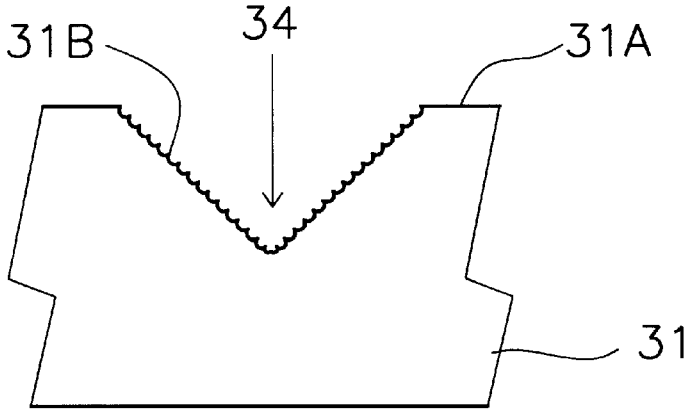
FIG. 4 shows a partially enlarged view of FIG. 3E for illustrating the scabrous surface of the V-groove.

The top surface of the silicon substrate 31 is then etched using photoresist pattern 33 and the etched silicon dioxide layer 32 as the mask. A peculiar etching solution (e.g., solution containing KOH) is chosen so as to orientation-dependently etches the silicon substrate 31. Since the etching rate of this etching solution to (100) face silicon is much faster than that to (111) face silicon, a V-groove (i.e., a groove with a V-shaped cross-section) is formed on the surface of silicon substrate 31 (FIG. 3D). The reason using the orientation-dependent etching process to form a V-groove will be illustrated later. However, other non-V-shaped grooves work as well. The mask above the surface of silicon substrate 31 is removed after etching process is complete, and a silicon substrate having a V-groove 34 is now obtained (FIG. 3E). Referring now to FIG. 4, a partially enlarged view of FIG. 3E, the surface of the etched silicon substrate 31 can be divided into two different portions: a smooth surface 31A which is the original surface of the silicon substrate 31, and a concave surface 31B which is the surface of the V-groove 34. The concave surface 31B is scabrous because it is formed by etching.

Figure 3F:
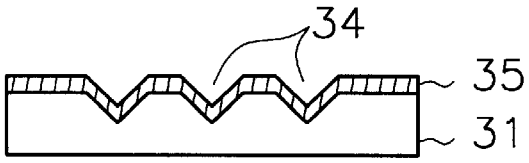
Figure 3C:
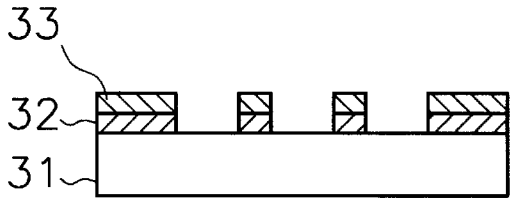
Figure 3G:
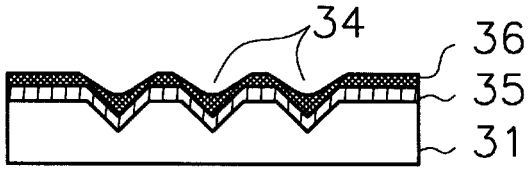
Figure 5:
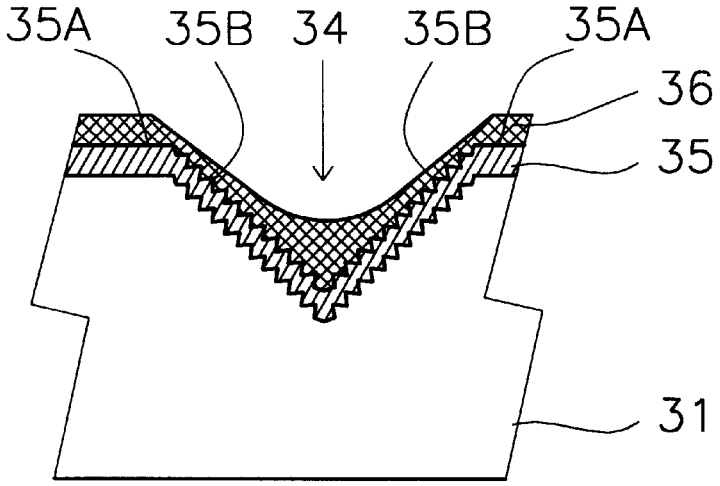
FIG. 5 shows a partially enlarged view of FIG. 3G for illustrating the detailed structures of the platinum layer, the silicon dioxide layer, and the substrate.

The etched silicon substrate 31 is then thermal-oxidized with high-temperature oxygen in a furnace to grow a layer of thermal-oxide (that is, silicon dioxide layer 35) as the dielectric layer on its upper surface (FIG. 3F). In addition to silicon dioxide, the dielectric layer can also be formed by other dielectric materials, e.g. silicon nitride ($Si_3N_4$). The silicon substrate 31 and the silicon dioxide layer 35 thereon are carefully treated to remove all impurities before proceeding the next step, thereby contamination to platinum is minimized. Referring to the partially enlarged view shown in FIG. 5, the silicon dioxide grown from the smooth surface 31A of silicon substrate 31 forms a smooth portion 35A, while the silicon dioxide grown from the scabrous concave surface 31B of silicon substrate 31 forms a rough concave portion 35B. The cross section of the V-groove 34 remains V-shaped. Subsequently platinum is sputtering deposited onto the top surface of the silicon dioxide layer 35 to form the platinum layer 36, as shown in FIG. 3G. FIG. 5 is a partially enlarged view of FIG. 3G for illustrating the detailed structures of the platinum layer 36, the silicon dioxide layer 35, and the silicon substrate 31. The area of the platinum layer 36 that is located on the smooth portion 35A forms an even film, while the platinum deposited within the V-groove 34 tends to cumulate at the bottom of the V-groove 34 instead of spreading over the concave portion 35B uniformly. The platinum layer 36 cumulated at the bottom of the V-groove 34 forms a substantially bulk structure, while the thickness of the upper portion of platinum layer 36 nearby the top of V-groove 34 becomes relatively thin.

Figure 6:
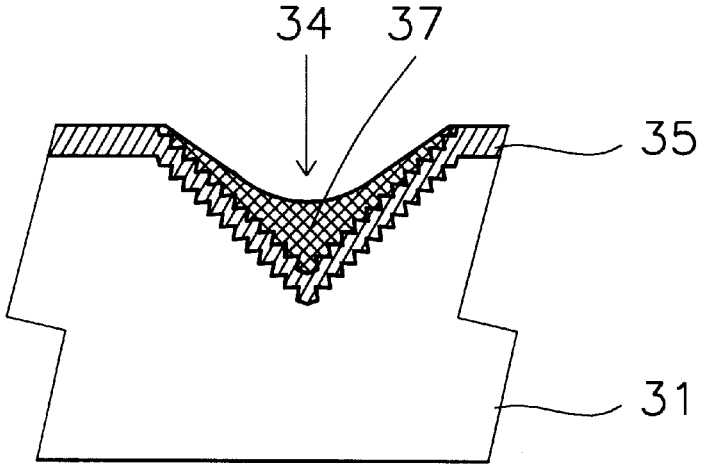
FIG. 6 is a partially enlarged view of FIG. 3H which shows part of the cross section of a fabricated platinum circuit according to the present invention.
Figure 7:
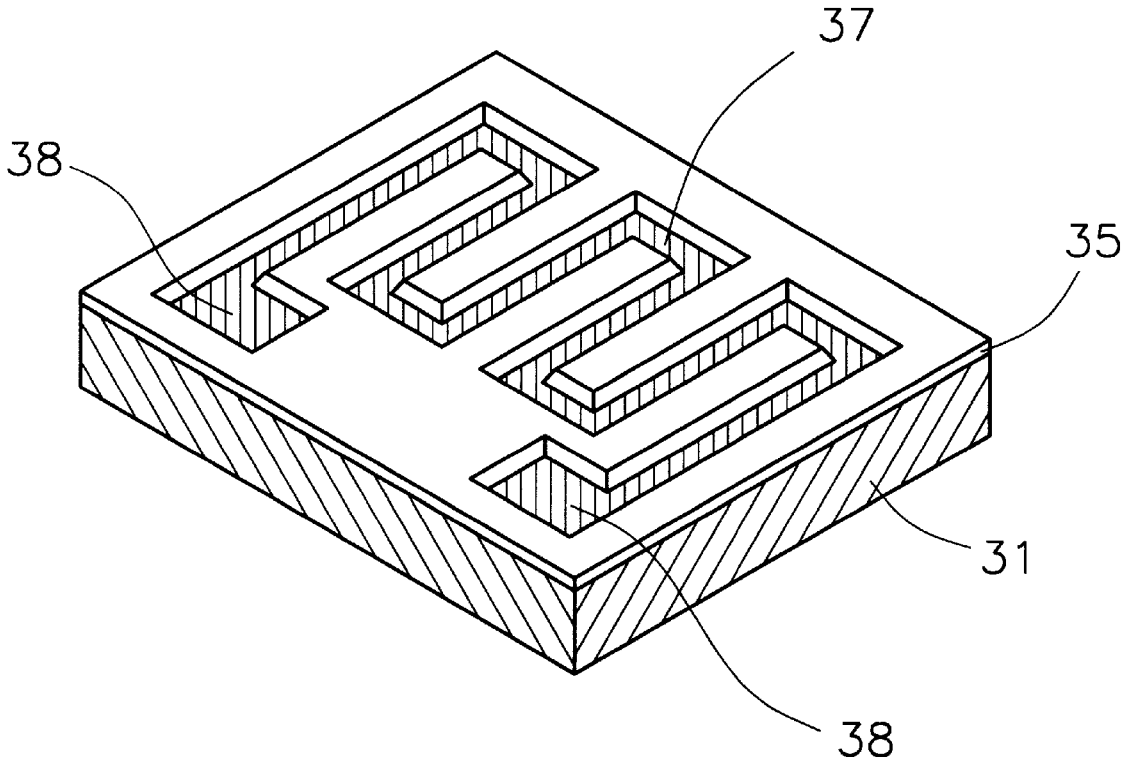
FIG. 7 is the gross perspective view of a platinum circuit of the a platinum resistance thermometer according to the preferred embodiment of the present invention.

The platinum-coated silicon substrate 31 is then subjected to gentle polishing. The slurry and polishing pad used are carefully chosen to ensure that contamination to platinum is avoided. Part of the platinum layer 36 located on the smooth portion 35A adheres to the silicon dioxide layer 35 loosely and exposes directly to the slurry and polishing pad, it is thus rubbed off easily. The platinum layer 36 deposited on the concave portion 35B inside the V-groove 34 adheres to the concave portion 35B firmly because of its rough surface, and is spatially protected by the groove structure without directly exposing to the polishing pad, thereby remains attached to the concave portion 35. In addition, the platinum layer 36 may also breaks along its thinner portion nearby the top of V-groove 34. From the aforementioned procedures of the present invention, unwanted portion of the platinum layer 36 can easily be removed from the substrate without contaminating the remaining platinum, while the remaining platinum layer on the concave portion 35B forms a platinum circuit 37 inside the V-groove 34, as shown in FIGS. 6 and 7. The pattern of the platinum circuit 37 are substantially identical to the pattern of V-groove 34, that is, identical to the desired platinum circuit pattern. The platinum circuit 37 thus formed has a substantially bulk structure, with which the TCR value of the platinum resistance thermometer according to the present invention becomes higher, and the sensitivity of a platinum resistance thermometer increases.

At both ends of the platinum circuit 37 are the bonding pads 38 where the platinum circuit 37 connects to the external circuits.

In addition to all the above benefits, the circuit integration of a platinum resistance thermometer according to the present invention can be increased by forming the circuit on a silicon substrate with the common integrated circuit techniques, thereby greatly reduces the size of platinum resistance thermometer.

The platinum resistance sensing element and the other integrated circuits can be formed on one single chip according to the present invention as the silicon substrate is utilized. Besides, trimming process for the platinum wiring becomes easier as its line width is reduced.

Additionally, the platinum circuit 37 is submerged within the V-groove 34, thereby is well-protected in the subsequent processing procedures like heat-treatment and bonding.

Here the present invention is described with a preferred embodiment. However, modifications and alternations can easily be made by those skilled in the art without departing from the true spirit of the invention. Therefore, the scope of the invention should be defined according to the following claims.

I claim:

1. A method for forming the sensing element of a platinum resistance thermometer, comprising the steps of:

forming a mask on the surface of a substrate, the pattern of said mask being substantially identical to the negative pattern of the platinum circuit of said sensing element;

etching said substrate through the opening of said mask to form a groove on the surface of said substrate, the pattern of said groove being substantially identical to the positive pattern of said platinum circuit of said sensing element;

removing said mask from said substrate completely;

forming a dielectric layer on the surface of said etched substrate and said groove, said dielectric layer being divided into a concave portion located on said groove and a smooth portion located on the surface of said substrate;

depositing a layer of platinum film on the surface of said dielectric layer, said platinum film being divided into a first platinum layer located on said concave portion within said groove and a second platinum layer located on said smooth portion on the surface of said substrate; and polishing said substrate having said dielectric layer and said platinum film thereon to remove said second platinum layer, said first platinum layer remaining attached to said concave portion, thereby forms said platinum circuit of said sensing element.

2. The method for forming the sensing element of a platinum resistance thermometer as described in claim 1, wherein said substrate is a silicon substrate.

3. The method for forming the sensing element of a platinum resistance thermometer as described in claim 2, wherein said dielectric layer is a silicon dioxide layer or a silicon nitride layer.

4. The method for forming the sensing element of a platinum resistance thermometer as described in claim 1, wherein said groove is a V-shaped groove.

5. A method for forming the sensing element of a platinum resistance thermometer, comprising the steps of:

forming a mask on the surface of a dielectric substrate, the pattern of said mask being substantially identical to the negative pattern of the platinum circuit of said sensing element;

etching said dielectric substrate through the opening of said mask to form a groove on the surface of said dielectric substrate, the pattern of said groove being substantially identical to the positive pattern of said platinum circuit of said sensing element; the surface of said dielectric substrate being divided into a concave portion located on said groove and a smooth portion located on the original surface of said dielectric substrate;

removing said mask from said substrate completely;

depositing a layer of platinum film on the surface of said dielectric substrate, said platinum film being divided into a first platinum layer located on said concave portion within said groove and a second platinum layer located on said smooth portion on the original surface of said dielectric substrate; and polishing said dielectric substrate having said platinum film thereon to remove said second platinum layer, said first platinum layer remaining attached to said concave portion, thereby forms said platinum circuit of said sensing element.

6. The method for forming the sensing element of a platinum resistance thermometer as described in claim 5, wherein said groove is a V-shaped groove.

* * * * *